US008262852B2

(12) United States Patent
Duggirala et al.

(10) Patent No.: US 8,262,852 B2
(45) Date of Patent: Sep. 11, 2012

(54) METHOD FOR IMPROVING FIBER QUALITY AND PROCESS EFFICIENCY IN MECHANICAL PULPING

(75) Inventors: Prasad Y. Duggirala, Naperville, IL (US); Sergey M. Shevchenko, Aurora, IL (US)

(73) Assignee: Nalco Company, Naperville, IL (US)

( * ) Notice: Subject to any disclaimer, the term of this patent is extended or adjusted under 35 U.S.C. 154(b) by 0 days.

(21) Appl. No.: 12/832,425

(22) Filed: Jul. 8, 2010

(65) Prior Publication Data

US 2010/0269993 A1 Oct. 28, 2010

Related U.S. Application Data

(62) Division of application No. 11/556,259, filed on Nov. 3, 2006, now abandoned.

(51) Int. Cl.
*D21B 1/16* (2006.01)

(52) U.S. Cl. ..... 162/25; 162/24; 162/73; 162/75; 162/77

(58) Field of Classification Search ..... 162/72, 162/75, 77, 24, 25
See application file for complete search history.

(56) References Cited

U.S. PATENT DOCUMENTS

| | | | | |
|---|---|---|---|---|
| 4,073,678 | A * | 2/1978 | Hammond et al. | 162/19 |
| 5,228,953 | A | 7/1993 | Bast et al. | |
| 5,549,787 | A | 8/1996 | Sain et al. | |
| 5,871,614 | A * | 2/1999 | Turner | 162/72 |
| 6,241,851 | B1 * | 6/2001 | Marcoccia | 162/19 |
| 6,527,914 | B1 | 3/2003 | Shevchenko et al. | |
| 6,599,326 | B1 | 7/2003 | Seltzer et al. | |
| 6,770,168 | B1 | 8/2004 | Stigsson | |
| 6,966,696 | B1 | 11/2005 | Curry et al. | |
| 7,081,183 | B2 | 7/2006 | Duggirala et al. | |
| 2002/0112828 | A1 * | 8/2002 | Khan et al. | 162/72 |
| 2004/0016526 | A1 * | 1/2004 | Duggirala et al. | 162/72 |
| 2004/0110651 | A1 | 6/2004 | Harmalker et al. | |
| 2005/0217813 | A1 | 10/2005 | Shevchenko et al. | |
| 2007/0062654 | A1 * | 3/2007 | Wang et al. | 162/72 |

FOREIGN PATENT DOCUMENTS

| | | |
|---|---|---|
| EP | 483571 B1 | 5/1992 |
| EP | 618289 B1 | 8/1998 |
| JP | 5-302288 | 11/1993 |
| JP | 08188976 | 7/1996 |
| JP | 08199489 | 8/1996 |
| WO | WO 03010264 | 2/2003 |

OTHER PUBLICATIONS

Smook, Handbook for Pulp and Paper Technologists, 1992, Angus Wilde Publications, 2nd edition, chapters 4 and 7.*

Bruce et al., Forest Products Biotechnology, 1998, Taylor and Francis Ltd, p. 100-101.*

Rozic et al., Purification of Effluent from the Groundwood Production by Organo-zeolite, Jan. 2008, Kemija u Indutriji, abstract only.*

* cited by examiner

*Primary Examiner* — Anthony Calandra

(74) *Attorney, Agent, or Firm* — Benjamin E. Carlsen; Andrew D. Sorenson

(57) ABSTRACT

This invention provides a composition and method for improving a mechanical pulping process by decreasing freeness and amount of shives, providing energy and chemical savings, and enhancing brightness and mechanical strength of a paper product made from a pulp material in the process. The composition includes formulations, such as surfactants, chelants, hydrotropes, reductive and oxidative pulp modifiers, and pH-controlling chemicals. The method includes selectively introducing these formulations to the pulp material in the mechanical pulping process.

15 Claims, No Drawings

METHOD FOR IMPROVING FIBER QUALITY AND PROCESS EFFICIENCY IN MECHANICAL PULPING

CROSS-REFERENCE TO RELATED APPLICATIONS

This application is a divisional application of and claims full priority from U.S. application Ser. No. 11/556,259 filed on Nov. 3, 2006 now abandoned.

STATEMENT REGARDING FEDERALLY SPONSORED RESEARCH OR DEVELOPMENT

Not Applicable.

BACKGROUND OF THE INVENTION

This invention relates generally to improving fiber quality and process efficiency in thermomechanical and chemi-thermomechanical pulping. More specifically, the invention relates to using specialty chemical compositions including various combinations of a surfactant, a chelant, and other compounds to improve the mechanical properties and brightness of a paper product produced from a pulp material manufactured in such a process. The invention has particular relevance for decreasing freeness and amount of shives, providing energy and chemical savings, and enhancing brightness and mechanical strength of paper products.

Mechanical pulping is a common method to produce inexpensive pulp without a significant loss of mass. Several technologies are currently practiced in mechanical pulping to manufacture products, such as stone ground wood (SGW), pressurized ground wood (PGW), refiner mechanical pulp (RMP), pressurized RMP (PRMP), thermo-RMP (TRMP), thermo-mechanical pulp (TMP), thermo-chemi-mechanical pulp (TCMP), thermo-mechanical-chemi pulp (TMCP), long fiber chemi-mechanical pulp (LFCMP), and chemically treated long fiber (CTLF).

Though purely mechanical pulps have some advantages, such as high opacity, high bulk, and good printing quality, they also have inherent disadvantages, such as low mechanical strength and susceptibility to yellowing. The yellowish color is due partly to formation of chromophoric and leuko-chromophoric structures in the production process as early as the first refining stage. The light absorption coefficient changes significantly as woodchips are converted into first-stage refined mechanical pulps. The greatest changes occur at wavelengths below 400 nanometers. In the presence of atmospheric oxygen, heat, and/or sunlight structures absorbing light in this region give rise to colored structures. Metal complexes and oxidation reactions may also play a role in creating the increased light absorbency. Avoiding the formation of these structures would result in mechanical pulps with increased brightness and enhanced brightness stability.

Chelants and surfactants (sometimes referred to as surface active agents) have historically had a place in pulp production. Mechanical pulp production is affected by transitional metal ions found in wood, which promote undesirable side reactions including oxidative reactions that cause yellowing. Currently, commodity chelants are used in mechanical pulping processes to immobilize such metal ions. The role of chelants is generally to bind transitional metal cations to prevent their catalytic activity in decomposing bleaching chemicals, such as peroxide, hydrosulfite, and the like. Surfactants have previously been employed in papermaking to accelerate fiber swelling, and to soften and split pulp.

The processes of bleaching and delignification of prepared pulp, but not mechanical pulp manufacturing, have involved combined use of surfactants and conventional chelants. For example, JP 05051889 A2 disclosed use of ethylenediaminetetraacetic acid ("EDTA") and diethylenetriamine pentaacetic acid ("DTPA") in oxygen treatment of wood pulp (i.e., delignification). Similar combinations used in ozone bleaching of chemical pulps have also been reported (JP 08188976 A2). Combined use of polymeric chelants and surface-active agents was proposed in JP 07138891 A2 for pulp pretreatment before peroxide bleaching.

Chelant and surfactant combinations have been applied in mechanical pulp production to improve the absorptive capacity of thermomechanical pulp in the course of continuous production from chips (SE 8002027). Pulp brightness, strength, and drainage properties have also been improved by washing woodchips with liquor containing chelants and surfactants between the impregnation and refining stages of the paper production process (See U.S. Pat. No. 5,549,787 and FR 2042117).

Mechanical pulps typically have low strength. Chemical treatment, such as alkalization, is sometimes used to increase strength, at the expense of brightness. There thus exists a need for economical methods of producing mechanical pulp materials having increased mechanical strength and brightness. In particular, it is desirable to develop a cost-efficient mechanical pulp with improved mechanical strength without sulfonation. Preferably, such a development would combine all components in a single composition. Preserving these pulp properties has been difficult without sacrificing printing properties and yield.

Thus there is clear need and utility for system and method for improving fiber quality and process efficiency in thermomechanical and chemi-thermomechanical pulping. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

At least one embodiment of the invention is directed towards a composition that decreases freeness and amount of shives, provides energy and chemical savings, and enhances brightness and mechanical strength of a paper product made from a pulp material in a mechanical pulping process. The composition includes one or more surfactants, one or more chelants, and one or more hydrotropes. The composition optionally includes one or more reductive or oxidative pulp modifiers and one or more pH-controlling chemicals.

In one aspect, the invention provides a composition that improves a mechanical pulping process. The composition includes an alkyl alcohol alkoxylate surfactant having formula $RO[(CH_2CHCH_3O)_X(CH_2CH_2O)_Y]M$. R may be a $C_4$ to $C_{40}$ straight, branched, or ring alkyl, X may be from 0 to about 50, Y may be from 1 to about 100, and M may be H or an alkali metal. In this aspect, the composition optionally includes one or more chelants, one or more hydrotropes, one or more reductive or oxidative pulp modifiers, and one or more pH-controlling chemicals.

In another aspect, the invention provides a method of decreasing freeness and amount of shives, providing energy and chemical savings, and enhancing brightness and mechanical strength of a paper product made from a pulp material produced in a mechanical pulping process. The method includes contacting the pulp material with a surfactant composition including an alkyl alcohol alkoxylate surfactant having formula $RO[(CH_2CHCH_3O_X(CH_2CH_2O)_Y]M$. R may be from $C_4$ to $C_{40}$ straight, branched, or ring alkyl, X may be from 1 to about 50, Y may be from 0 to about 100, and M may be H or an alkali metal.

The method further includes optionally introducing to the pulp material separately from the surfactant composition, as part of the surfactant composition, or with the surfactant composition but not as part of the surfactant composition one or more additional formulations. These formulations include one or more additional surfactants, one or more chelants, one or more hydrotropes, one or more reductive pulp modifiers, one or more oxidative pulp modifiers, one or more pH-controlling chemicals, and combinations thereof.

It is an advantage of the invention to provide compositions that decrease freeness and amount of shives, provide energy and chemical savings, and enhance brightness and mechanical strength of a paper product produced from a pulp material produced in a mechanical pulping process.

A further advantage of the invention is to provide an economical and efficient method of producing a high-quality paper product via a mechanical pulping process.

It is another advantage of the invention to provide a composition that helps prevent formation of chromophoric and leukochromophoric structures in mechanical pulping processes thus enhancing brightness and brightness stability of pulp materials.

It is a further advantage of the invention to provide a synergistic method of producing a paper product having resistance to brightness loss and increased mechanical strength under energy and chemical saving mechanical pulping process conditions.

Another advantage of the invention is to provide a method of improving a mechanical pulping process by contacting a pulp material with a surfactant composition and introducing to the pulp material one or more formulations including a pH-controlling chemical at the same stage of the mechanical pulping process; wherein if the pH-controlling chemical is an alkali and is introduced to the pulp material separately from the surfactant composition, the alkali improves the mechanical strength of the paper product without decreasing the brightness of the paper product.

DETAILED DESCRIPTION OF THE INVENTION

The following definitions are intended as guidelines and not intended to limit the scope of the invention. The organization is for convenience only and is not intended to limit any of the definitions to any particular category.

"Alkyl alcohol" means a compound or mixture of compounds having the formula ROH where R is a straight, branched, or ring $C_4$ to $C_{40}$ alkyl group.

"Alkoxy" means an alkyl group attached to the parent molecular moiety through an oxygen atom. Representative alkoxy groups include methoxy, ethoxy, propoxy, butoxy, and the like. Propoxy and ethoxy are preferred.

"Alkyl" means a monovalent group derived from a straight or branched chain or ring saturated hydrocarbon by the removal of a single hydrogen atom. The alkyl may be unsubstituted or substituted with one or more groups selected from amino, alkoxy, hydroxy and halogen. Representative alkyl groups include methyl, ethyl, n- and iso-propyl, n-, sec-, iso- and tert-butyl, and the like.

"Hydroxide base" means hydroxide (OH) salts of alkaline and alkaline earth metals, such as sodium, potassium, lithium, magnesium, calcium, the like, and combinations thereof.

"Block polymer" means the polymer resulting from block addition of more than one different type of monomer, such as propylene oxide and ethylene oxide.

"Homo polymer" means the polymer resulting from the polymerization of one type of monomer, such as propylene oxide or ethylene oxide.

"Hetero polymer" means the polymer resulting from random addition of more than one type of monomer, such as propylene oxide and ethylene oxide.

"Formulation" as used herein includes one or more chemicals in solid, powder, crystalline, or other form and/or a solution of one or more chemicals in any suitable solvent in any appropriate concentration.

"Oven-dry pulp" means a paper or pulp that has been dried in an oven, contains practically no moisture, and has constant weight within about 0.1 percent.

"pH-controlling chemical" means any suitable chemical or compound that, when added to a solution, composition, and/or formulation, is capable of adjusting pH, controlling pH, and/or maintaining pH.

"Active solids" means percent of solid active components of a material remaining after drying of a formulation. Inactive admixtures (e.g., sodium chloride) are not considered an active solid.

"CSF" means Canadian Standard Freeness as described in TAPPI methods and measured in milliliters.

Chelant-Related Definitions

"Carboxylic acids" means organic compounds containing one or more carboxylic group(s), —C(O)OH, preferably aminocarboxylic acids containing a single C—N bond adjacent (vicinal) to the $C—CO_2H$ bond, such as:

EDTA $((HO_2CCH_2)_2NCH_2CH_2N(CH_2CO_2H)_2)$,

DTPA $(HO_2CCH_2)_2NCH_2CH_2N(CH_2CO_2H)CH_2CH—_2N(CH_2CO_2H)_2)$, the like, and alkaline and alkaline earth metal salts thereof.

"DTPA" means diethylenetriamine pentaacetic acid.

"EDTA" means ethylenediaminetetraacetic acid.

"Dithiocarbamates" include monomeric dithiocarbamates, polymeric dithiocarbamates, polydiallylamine dithiocarbamates, 2,4,6-trimercapto-1,3,5-triazine, disodium ethylenebis-dithiocarbamate, disodium dimethyldithiocarbamate, and the like.

"Organic phosphates" means organic derivatives of phosphorous acid, $P(O)(OH)_3$, containing single C—O—P bonds, including triethanolamine tri(phosphate ester) $(N(CH_2CH_2OP(O)(OH)_2)_3)$, and the like.

"Organic phosphonates" means organic derivatives of phosphonic acid, $HP(O)(OH)_2$, containing a single C—P bond, such as HEDP $(CH_3C(OH)(P(O)(OH)_2)$, 1-hydroxy-1, 3-propanediylbis-phosphonic acid $((HO)_2P(O)CH(OH)CH_2CH_2P(O)(OH)_2))$; preferably containing a single C—N bond adjacent (vicinal) to the C—P bond, such as:

DTMPA $((HO)_2P(O)CH_2N[CH_2CH_2N(CH_2P(O)(OH)_2)_2]—_2)$,

AMP $(N(CH_2P(O)(OH)_2)_3)$,

PAPEMP $((HO)P(O)CH_2)_2NCH(CH_3)CH_2(OCH_2CH(CH—_3))_2N(CH_2)_6N(CH_2P(O)(OH)_2)_2)$,

HMDTMP $((HO)_2P(O)CH_2)_2N(CH_2)_6N(CH_2P(O)(OH)_2)_2)$,

HEBMP $(N(CH_2P(O)(OH)2)_2CH_2CH_2OH)$, and the like.

Reductive Pulp Modifier-Related Definitions

"Sulfites" means dibasic metal salts of sulfurous acid, $H_2SO_3$, including dibasic alkali and alkaline earth metal salts such as sodium sulfite $(Na_2SO_3)$, calcium sulfite $(CaSO_3)$, and the like.

"Bisulfites" means monobasic metal salts of sulfurous acid, $H_2SO_3$, including alkali and alkaline earth metal monobasic salts such as sodium bisulfite ($NaHSO_3$), magnesium bisulfite ($Mg(HSO_3)_2$), and the like.

"Metabisulfites (Pyrosulfites)" means salts of pyrosulfurous acid, $H_2S_2O_5$, including sodium metabisulfite ($Na_2S_2O_5$), and the like.

"Sulfoxylates" means salts of sulfoxylic acid, $H_2SO_2$, including zinc sulfoxylate ($ZnSO_2$), and the like.

"Thiosulfates" means salts of thiosulfurous acid, $H_2S_2O_3$, including potassium thiosulfate ($Na_2S_2O_3$), and the like.

"Polythionates" means salts of polythionic acid, $H_2S_nO_6$ (n is from 2 to 6), including sodium trithionate ($Na_2S_3O_6$), salts of dithionic acid, $H_2S_2O_6$, such as sodium dithionate $Na_2S_2O_6$, and the like.

"Dithionites (hydrosulfites)" means salts of dithionous (hydrosulfurous, hyposulfurous) acid, $H_2S_2O_4$, including sodium dithionite (hydrosulfite) ($Na_2S_2O_4$), magnesium dithionite ($MgS_2O_4$), and the like.

"Formamidinesulfinic acid (FAS)" means a compound of formula $H_2NC(=NH)SO_2H$ and its salts and derivatives including the sodium salt $H_2NC(=NH)SO_2Na$.

"Aldehyde bisulfite adducts" means compounds of formula $R_1CH(OH)SO_3H$ and metal salts thereof where $R_1$ is selected from alkyl, alkenyl, aryl and arylalkyl. Representative aldehyde bisulfite adducts include formaldehyde bisulfite adduct $HOCH_2SO_3Na$, and the like.

"Sulfinamides and ethers of sulfinic acid" means compounds of formula $R_1$—S(=O)—$R_2$, where $R_1$ is defined above and $R_2$ is selected from $OR_3$ and $NR_4R_5$, where $R_3$-$R_5$ are independently selected from selected from alkyl, alkenyl, aryl and arylalkyl. Representative sulfinamides include ethylsulfindimethylamide ($CH_3CH_2S(=O)N(CH_3)_2$), and the like.

"Sulfenamides and ethers of sulfenic acid" means compounds of formula $R_1$—S—$R_2$, where $R_1$ and $R_2$ are defined above. Representative sulfenamides include ethylsulfendimethylamide ($CH_3CH_2SN(CH_3)_2$), and the like.

"Sulfamides" means compounds of formula $R_1$–C(=S)—$NR_4R_5$, where $R_1$, $R_4$ and $R_5$ are defined above. Representative sulfamides include $CH_3CH_2C(=S)N(CH_3)_2$, and the like.

"Phosphines" means derivatives of phosphine, $PH_3$, normally organic substituted phosphines of the formula $R_6R_7R_8P$ where $R_6$ to $R_8$ are independently selected from hydrogen, alkyl, alkenyl, aryl, arylalkyl (defined below) and $NR_4R_5$ where $R_4$ and $R_5$ is defined above. Representative phosphines include $(HOCH_2)_3P$ (THP), and the like.

"Phosphites" means derivatives of phosphorous acid $P(OH)_3$, including organic substituted phosphites of the formula $(R_3O)(R_4O)(R_5O)P$ where $R_3$-$R_5$ are defined above. Representative phosphites include $(CH_3CH_2O)_3P$, and the like.

"Thiophosphites" means derivatives of phosphorothious acid $HSP(OH)_2$, including organic substituted thiophosphites of formula $(R_3O)(R_4O)(R_5S)P$ where $R_3$ to $R_5$ are defined above. Representative thiophosphites include $(CH_3CH_2O)_2(CH_3CH_2S)P$, and the like.

"Phosphonium salts" means organic substituted phosphines of the formula $R_1R_3R_4R_5P^+X^-$, where $R_1$ and $R_4$ to $R_5$ are as defined above and X is any organic or inorganic anion. Representative phosphonium salts include $(HO_2CCH_2CH_2)_3P^+HCl^-$ (THP), $[(HOCH_2)_4P^+]_2(SO_4)^{2-}$ (BTHP), and the like.

"Alkenyl" means a monovalent group derived from a straight or branched hydrocarbon containing at least one carbon-carbon double bond by the removal of a single hydrogen atom. The alkenyl may be unsubstituted or substituted with one or more groups selected from amino, alkoxy, hydroxyl, and halogen.

"Alkylene" means a divalent group derived from a straight or branched chain saturated hydrocarbon by the removal of two hydrogen atoms, for example methylene, 1,2-ethylene, 1,1-ethylene, 1,3-propylene, 2,2-dimethylpropylene, and the like.

"Aryl" means aromatic carbocyclic radicals and heterocyclic radicals having about 5 to about 14 ring atoms. The aryl may be unsubstituted or substituted with one or more groups selected from amino, alkoxy, hydroxy and halogen. Representative aryls include phenyl, naphthyl, phenanthryl, anthracyl, pyridyl, furyl, pyrrolyl, quinolyl, thienyl, thiazolyl, pyrimidyl, indolyl, and the like.

"Arylalkyl" means an aryl group attached to the parent molecular moiety through an alkylene group. Representative arylalkyl groups include benzyl, 2-phenylethyl, and the like.

Oxidative Pulp Modifier-Related Definitions

"Organic peroxyacid" means compounds of formula $R_1C(O)O_2H$ and metal salts thereof where $R_1$ is selected from alkyl, alkenyl, aryl and arylalkyl. Representative organic peroxyacids include peroxybenzoic acid, $C_6H_5C(O)OOH$, peracetic acid (PAA), $CH_3C(O)OOH$, performic acid, $HC(O)OOH$, perpropionic acid, $CH_3CH_2C(O)OOH$, and the like.

"Inorganic peroxides" means monobasic (hydroperoxides) and dibasic (peroxides) metal derivatives of hydrogen peroxide, $H_2O_2$, including alkali and alkaline earth metal derivatives such as sodium hydroperoxide (NaOOH), magnesium peroxide ($MgO_2$), and the like.

"Superoxides" means metal derivatives containing the group of $O_2^-$, including alkali and alkaline earth metal derivatives such as sodium superoxide ($NaO_2$), and the like.

"Peroxide-superoxides" means mixed alkali metal derivatives of a formula $2MO_2.M_2O_2$, where M is an alkali or alkaline earth metal, such as $K_2O_3$, and the like.

"Inorganic peroxy acids and salts thereof" means inorganic acids containing a —O—O— group, including peroxy monoacids containing the group —OOH and peroxy diacids containing the group —O—O—, and their metal salts, such as peroxymonosulfuric acid (Caro's acid, $(HO)_2SO_2OOH$), peroxydisulfuric acid ($HOSO_2OOSO_2OH$), peroxymonophosphoric acid $H_3PO_5$, sodium peroxymonocarbonate $Na_2CO_4$ and peroxydicarbonate $Na_2C_2O_6$, and the like.

"Peroxyhydrates" are inorganic salts containing hydrogen peroxide of crystallization, such as sodium metasilicate peroxyhydrate $Na_2SiO_3.H_2O_2.H_2O$, and sodium borate peroxyhydrate $NaBO_2.H_2O_2.3H_2O$, and the like.

"Organic peroxides" are any organic chemicals containing a —O—O— group, including organic peroxyacids as defined herein, dioxiranes such as dimethyldioxyrane $(CH_3)_2CO_2$, and the like.

"Nitrosodisulfonates" are alkali and alkaline earth metal salts of nitrosodisulfonic acid such as potassium nitrosodisulfonate (Fremy's salt) $(KSO_3)_2NO$, and the like.

"Hypochlorites", "chlorites", "chlorates" and "perchlorates", are water-soluble metal salts of hypochlorous HOCl, chlorous HOClO, chloric $HOClO_2$ and perchloric $HOClO_3$ acids, respectively, such as sodium hypochlorite, NaOCl, and the like.

"Hypobromites" and "bromites" are water soluble salts of hypobromous acid, HOBr, and bromic acid, $HBrO_3$, respectively, including sodium hypobromite, NaOBr, and the like.

"Chloroamines" and "bromoamines" are ammonium derivatives of the formulae $NH_xHal_y$, where Hal is Cl or Br, or alkylamine derivatives $NR_1R_2Hal_x$, where $R_1$ and $R_2$ are defined above and x and y are independently 1 to 3. In aqueous solution, chloramines and bromoamines may be present as the corresponding ammonium salts.

"Chloroamides" and "bromoamides" are amide derivatives containing —$C(O)N(R_1)_pH_qHal_r$ groups where Hal is defined above, p and q are independently 0 to 1 and r is 1 to 2, such as product compositions formed in a mixture of sodium hypochlorite NaClO and urea $H_2NCONH_2$ or sodium hypochlorite NaClO and 5,5-dimethylhydantoin, and the like.

"Chlorosulfamides" and "bromosulfamides" are amide derivatives containing —$SO_2N(R_1)_pH_qHal_r$, where $R_1$, Hal, p, q and r are defined above, such as the product composition formed in a mixture of sodium hypochlorite, NaClO, and sulfamide, $H_2NSO_2NH_2$, and the like.

"Chlorosulfonic acid" is a chemical of the formula $ClSO_3H$.

"Activated oxidizing agent" means an oxidizing agent used in combination with one or more activators. In some embodiments, the oxidizing agent is activated hydrogen peroxide.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims.

Surfactant Preparation

The alkyl alcohol alkoxylates of this invention have the formula $RO[(CH_2CHCH_3O)_X(CH_2CH_2O)_Y]M$. R may be from $C_4$ to $C_{40}$ straight, branched, or ring alkyl, X may be from 1 to about 50, Y may be from 0 to about 100, and M may be hydrogen or an alkali metal. It is contemplated that the structure of the alkyl alcohol alkoxylate may be a block polymer, a hetero polymer, a homo polymer, or combinations thereof. In one preferred embodiment, X is from 1 to 20, Y is from 20 to 80, and M is hydrogen. In a preferred embodiment, M is hydrogen. In another preferred embodiment, M is potassium. In alternative preferred embodiments, R is a $C_8$ to $C_{22}$ alkyl or a $C_{16}$ alkyl. In a further embodiment, X is from 1 to 20. In another embodiment, Y is from 20 to 80.

They are typically prepared by heating a $C_4$ to $C_{40}$ alkyl alcohol, or mixture of $C_4$ to $C_{40}$ alkyl alcohols (sometimes referred to herein as ROH) with propylene oxide and/or ethylene oxide in the presence of hydroxide base. The ethylene oxide and propylene oxide may be added in random or block fashion, resulting in either a hetero polymer or a block polymer, respectively. The reaction is preferably conducted at a temperature of about 150° C. in a pressure vessel at a pressure of about 50 psi to about 75 psi. The alkoxylate product may either be left in salt form or neutralized with acid.

Random addition of ethylene oxide and propylene oxide involves simultaneous addition of both components to the alcohol, such that the rate of addition is controlled by their relative amounts and reaction rates. In the case of random addition, it should be appreciated that the above formula is not a structural formula. Rather, it is a representation of molar amounts, X and Y, of ethylene oxide and propylene oxide added to the alcohol.

In block addition, either the ethylene oxide or the propylene oxide is added first to the alcohol and allowed to react. The other component is then added to the alcohol and allowed to react. In this case, the above formula is representative of the structure of the alkoxylated alcohol, except that the $(C_2H_4O)_X$ and $(C_3H_6O)_Y$ groups may be reversed, depending on the order of propylene oxide or ethylene oxide addition. The resulting polymer is a highly water-soluble solid.

Composition

In a preferred aspect, the composition of the invention is an alkyl alcohol alkoxylate surfactant having formula $RO[(CH_2CHCH_3O)_X(CH_2CH_2O)_Y]M$; wherein R is $C_4$ to $C_{40}$ straight, branched, or ring alkyl, X is from 1 to about 50, Y is from 0 to about 100, and M is H or an alkali metal, as explained in more detail above. In this embodiment, the composition optionally includes one or more chelants, one or more hydrotropees, one or more reductive or oxidative pulp modifiers, and one or more pH-controlling chemicals (each explained in more detail herein).

The composition of the invention, in one embodiment, includes an effective amount of a surfactant formulation having one or more surfactants. The role of the surfactants is to improve penetration of liquid or steam into the woodchips thus facilitating homogenization in the mechanical pulping process. It is contemplated that a variety of surfactants may be used in accordance with the invention. Representative surfactants include non-ionic surfactants, alkyl alcohol alkoxylates (as above); block, homo, and hetero polymer alkyl alcohol alkoxylates; ethoxylated tridecyl alcohol; ethoxylated propyloxylated hexadecanol; the like; and combinations thereof. The surfactant formulation typically has from about 0.05 weight percent to about 30 weight percent of one or more surfactants. In a preferred embodiment, the composition has from about 1 weight percent to about 10 weight percent of one or more surfactants.

In another preferred embodiment, the composition includes surfactant alone and has from about 0.05 weight percent to about 99 weight percent of one or more surfactants. Preferably, such a surfactant only composition has from about 5 weight percent to about 30 weight percent of one or more surfactants. In a more preferred embodiment, the surfactant only composition has from about 10 weight percent to about 20 weight percent of one or more surfactants.

In a preferred aspect, the composition also includes an effective amount of a chelant formulation having one or more chelants. As stated above, the presence of metal ions, such as transitional metal ions, promote undesirable side reactions including oxidative reactions and complex formation with lignin that cause yellowing. Chelants efficiently immobilize these ions to prevent such undesirable side reactions. Effective chelants include transitional metal chelants, such as aminocarboxylates, aminophosphonates, polyphosphates, polyacrylates, organic phosphates, organic phosphonates, phosphates, carboxylic acids, the like, and combinations thereof. Preferred chelants include carboxylic acid, phosphonates, DTPA and salts thereof, EDTA and salts thereof, and DTMPA and salts thereof. Typically, about 0.05 weight percent to about 50 weight percent chelant is sufficient. Preferably the chelant is present from about 1 weight percent to about 30 weight percent. Most preferably, the composition includes from about 5 weight percent to about 20 weight percent of one or more chelants.

In one aspect, the composition includes an effective amount of a hydrotrope formulation having one or more hydrotropes. Contemplated hydrotropes include arylenesulfonates, such as xylenesulfonate, cumenesulfonate, and toluenesulfonate and carbohydrates having long-chain aliphatic substituents, such as Glucopon® (available from Fitz Chem Corp. in Itasca, Ill.) and Glucopon®-like compounds.

An example of a Glucopon compound is Glucopon 425N, D-glucose, decyl ethers, octyl ethers, oligomeric D-glucopyranoside, $C_{10}$ to $C_{16}$ alkyloligomeric (available from Cognis Corporation in Hoboken, N.J.).

It is further contemplated that the hydrotrope formulation may include any combination of these and similar compounds. In an embodiment, the composition has from about 0.05 weight percent to about 50 weight percent of one or more hydrotropes. Preferably, the composition includes from about 0.05 weight percent to about 50 weight percent of the hydrotrope(s). In another preferred embodiment, the composition has from about 5 weight percent to about 30 weight percent hydrotrope. The most preferred hydrotrope content of the composition is from about 10 weight percent to about 20 weight percent.

In one embodiment that contains the hydrotrope formulation, the weight percent ratio of hydrotrope to chelant is typically about one-to-one or greater. In another embodiment, the weight percent ratio of hydrotrope to surfactant is typically about two-to-one or greater.

The presence of one or more hydrotropes in the composition acts to increase the aqueous solubility of certain slightly soluble compounds. Generally, all the individual components of the invention are soluble in water; however, certain combinations, such as a nonionic surfactant with other, more polar components, may require a wetting agent, such as a hydrotrope to provide compatibility of the composition in a single formulation. In an embodiment where the composition is applied as a single mixture, rather than as separate components, operational and performance advantages are observed.

A preferred embodiment includes using one or more non-ionic surfactants, which are typically not compatible with chelants. For example, if the composition includes ethoxylated, propoxylated hexadecanol (a preferred surfactant) and pentasodium DTPA (a preferred chelant), the non-polar surfactant component precipitates. Incorporating a hydrotrope in the correct ratio (as explained below) maintains solubility of the non-ionic components and thus ensures stability of the composition.

A synergistic effect is observed with the addition of a reductive pulp modifier to the composition. Such reductive pulp modifiers include those compounds that are capable of transforming functional groups in bleached pulp from a higher oxidation category to a lower oxidation category. Representative reductive pulp modifiers include water-soluble inorganic sulfites, bisulfites, metabisulfites, substituted phosphines and tertiary salts thereof, formamidinesulfinic acid and salts and derivatives thereof, formaldehyde bisulfite adduct other aldehyde bisulfite adducts, sulfoxylates, thiosulfates, dithionites, polythionates, sulfinamides and ethers of sulfinic acid, sulfenamides and ethers of sulfenic acid, sulfamides, phosphines, phosphonium salts, phosphites, thiophosphites, the like, and combinations thereof. Preferred reductive pulp modifiers include sodium sulfite, bisulfite, and metabisulfite.

The effective amount of reductive pulp modifier added to the pulp material is the amount that enhances the brightness and resistance to thermal yellowing in the mechanical pulping of wood that brings increased brightness of the pulp material or paper product compared to untreated pulp material or paper product. Typically, about 0.01 to about 50 weight percent of one or more reductive pulp modifiers is effective. A more preferred amount is from about 5 weight percent to about 30 weight percent. The most preferred range is from about 10 weight percent to about 20 weight percent.

In another aspect, the composition includes addition of an effective amount of one or more oxidative pulp modifiers. Oxidative pulp modifiers include those chemical substances capable of transforming functional groups in pulp material from a lower oxidation category to a higher oxidation category. Benefits of this transformation include increased brightness and resistance to thermal yellowing in the mechanical pulping of wood that brings higher brightness of the pulp material or paper product compared to untreated pulp material or paper product. Effective amounts of one or more oxidative pulp modifiers are contemplated to be in the range of about 0.01 weight percent to about 50 weight percent. Preferably, one or more oxidative pulp modifiers are present from about 1 weight percent to 20 weight percent. Most preferably, the composition includes about 5 weight percent to about 15 weight percent of one or more oxidative pulp modifiers.

Representative oxidative pulp modifiers include percarbonates, perborates, hydrogen peroxide, activated hydrogen peroxide, organic peroxyacids and salts thereof, dioxiranes, halogenamines, inorganic peroxides, superoxides and peroxide-superoxides, inorganic peroxyacids and salts thereof, peroxyhydrates, water-soluble organic peroxides, nitrosodisulfonates, hypochlorites, hypobromites, chlorites, chlorates, bromates, perchlorates, chlorine dioxide, chloroamines, chloroamides, chlorosulfamides, bromoamines, bromoamides, bromosulfamides, chlorosulfonic acid, bromosulfonic acid, chlorine, the like, and combinations thereof.

The oxidative pulp modifier may be used in combination with one or more "activators." The activators include compositions that enhance the effect of the oxidizing agent through catalysis of the oxidation reaction, change in pH, or both. Representative activators include, but are not limited to phosphoric acid; monosodium phosphate; monosodium sulfate; monosodium carbonate; TEMPO (2,2,6,6-tetramethylpiperydidnyoloxyl); 4-hydroxy-TEMPO; ammonium molybdate; tetraacetylethylenediamine (TAED); and pH-changing chemicals affecting oxidation rates, such as acetic acid.

The presence of alkali (a representative pH-controlling chemical) typically strengthens the paper product at the expense of decreasing its brightness. In one embodiment, the invention includes use of alkali or other pH-controlling chemicals. The composition and method of the invention have the benefit of enabling use of such alkali or pH-controlling chemicals to increase mechanical strength of the paper product without reducing its brightness. Representative pH-controlling chemicals include trisodium phosphate, sodium metaborate, ammonium carbonate, sodium hydroxide, potassium hydroxide, lithium hydroxide, tetramethylammonium hydroxide, ammonium hydroxide, magnesium hydroxide, magnesium carbonate, sodium silicate, sodium carbonate, the like, and combinations thereof. Typically, in an embodiment, the composition includes about 5 weight percent to about 90 weight percent of the pH-controlling chemical. A more preferred range of one or more pH-controlling chemicals in the composition is from about 20 weight percent to about 50 weight percent.

It should be appreciated that the composition may include other organic and inorganic compounds, for example, salts, solvents, and/or wetting agents as needed in certain applications. Any other such compounds may be included without varying from the scope of the invention.

Method of Application

The composition may be applied onto wood chips or pulp material to prepare the material for mechanical pulping (e.g., in a chip silo, conveyer belt, or atmospheric steaming bean) or during mechanical pulping (e.g., grinding, refining). The components can be applied separately at different stages of the process. For example, a surfactant may be contacted with the wood chips on the conveyor belt and a reductive pulp modifier may be introduced to the pulp material during refining. The preferred way to implement the method of the invention is in a single formulation before or during the mechanical pulping process.

It should be appreciated that the composition may be applied by any means available, such as spraying on wood chip stock, mixing with the liquor (i.e., dilution water), applying with steam (e.g., in a refiner via steam tubes), the like, and combinations thereof. The precise location where the composition of the invention is applied, either as a single formulation or in separate components, depends on the specific equipment involved, the exact process conditions being used and the like. In some cases, the composition may be added at one or more locations for optimal effectiveness.

In one embodiment, the composition of the invention is directly fed into the refiner at the mechanical pulping stage. In an embodiment, the method includes contacting the pulp material with about 0.001 weight percent to about 5 weight percent of the alkyl alcohol alkoxylate surfactant (as explained in more detail above), based on oven-dry pulp. More preferably, the surfactant level is from about 0.003 weight percent to about 0.2 weight percent, based on oven-dry pulp. The most preferred surfactant level is from about 0.005 weight percent to 0.1 weight percent, based on oven-dry pulp.

In another embodiment, the method includes introducing to the pulp material about 0.005 weight percent to about 5 weight percent of one or more reductive pulp modifiers (as explained in more detail above), based on oven-dry pulp. Preferably, the reductive pulp modifier is added from about 0.01 weight percent to about 0.5 weight percent, based on oven-dry pulp. Most preferably, one or more reductive pulp modifiers are added from about 0.02 weight percent to about 0.1 weight percent, based on oven-dry pulp.

In one embodiment, the method includes introducing to the pulp material about 0.01 weight percent to about 5 weight percent of one or more oxidative pulp modifiers, based on oven-dry pulp. A preferred level of the oxidative pulp modifier is from about 0.01 weight percent to about 0.5 weight percent, based on oven-dry pulp. A most preferred dosage of one or more oxidative pulp modifiers from about 0.02 weight percent to about 0.1 weight percent, based on oven-dry pulp.

One or more chemicals to control or adjust pH are needed in certain embodiments. The level of pH-controlling chemical may vary depending upon the pH requirements or pH of the system. These embodiments include introducing to the pulp material (as stated, either separately or mixed with one or more other components of the composition) from about 0.05 weight percent to about 10 weight percent of one or more pH-controlling chemicals, based on oven-dry pulp. In one embodiment, the pH-controlling chemicals are introduced from about 0.1 weight percent to about 2 weight percent, based on oven-dry pulp. In a preferred embodiment, the pH-controlling chemicals are used from about 0.4 weight percent to about 1 weight percent, based on oven-dry pulp.

EXAMPLES

The foregoing may be better understood by reference to the following examples, which are intended to illustrate methods for carrying out the invention and are not intended to limit the scope of the invention.

Compositions used in the following examples are listed below. All percentages are in weight percent, unless indicated otherwise.

i. Composition A: about 14.5% chelant, about 17.5% hydrotrope, and about 3% surfactant.
ii. Composition A1: about 0.15% chelant and about 0.15% Composition A.
iii. Composition B: about 5.4% chelant, about 15.2% hydrotrope, about 1.3% surfactant, and about 16.2% reductive pulp modifier.
iv. Composition B1: about 0.3% Composition A and about 0.2% reductive pulp modifier.
v. Composition C: about 0.3% Composition A, about 0.2% reductive pulp modifier, and about 2% pH-controlling chemical.
vi. Composition C1: about 0.3% Composition A, about 0.2% reductive pulp modifier, and about 1% trisodium phosphate ($Na_3PO_4$).
vii. Composition C2: about 0.3% Composition A, about 0.2% reductive pulp modifier, and about 0.5% pH-controlling chemical.
viii. Composition D: about 0.5% Composition B and about 0.5% NaOH.
ix. Composition E: about 0.3% Composition A, about 0.2% reductive pulp modifier, and about 0.5% pH-controlling chemical.
x. Composition F: about 0.3% Composition A, about 0.2% reductive pulp modifier, and about 1% sodium metaborate ($NaBO_2$).
xi. Composition G: about 0.5% Composition A and about 1% oxidative pulp modifier.
xii. Composition H: about 0.5% Composition A and about 1% oxidative pulp modifier.
xiii. Composition I: about 0.3% Composition A, about 0.2% reductive pulp modifier, about 0.25% alkali, and about 0.25% pH-controlling chemical.
xiv. Composition J: about 0.3% Composition A, about 0.2% reductive pulp modifier, and about 0.5% pH-controlling chemical.
xv. Composition K: about 16% surfactant.
xvi. Composition L: about 24% pH-controlling chemical, about 2% chelant, and about 9.5% reductive pulp modifier.
xvii. Composition M: about 0.1% Composition L and about 0.5% sodium hydroxide.
xviii. Composition N: about 24% pH-controlling chemical, about 2% chelant, and about 9.5% sodium sulfite.
xix. Composition O: about 0.5% Composition N and about 0.5% sodium hydroxide.

For the below examples, the pulp materials and process conditions were chosen based on freeness so that the treatments would not reduce the freeness to values lower than 200 ml CSF. Pulp material was typically mixed with the composition and may be heated and cooked in a digester at between about 120° C. and about 150° C. Alternative methods of heating include preheating in a microwave at about 80° C., heating with infrared energy, or by heating using any suitable means. The digested pulp may subsequently be refined in a PFI mill running from about 2,000 RPM to about 20,000 RPM, depending on the setting.

The treated pulp was diluted with deionized water to 5 percent consistency and then dewatered to 20 percent consistency. The dewatered pulp was bleached at 10 percent consistency at 70° C. for about 1 hour with from 2.5 to 3 weight percent $H_2O_2$, about 2 weight percent NaOH, and optionally about 1.13 weight percent sodium silicate. Handsheets were made using a Büchner funnel (5 gram o.d. pulp, ø15 cm, pressed and air-dried) and/or a Noble&Wood handsheet mold (8 $in^2$, 60 $g/m^2$). Brightness was measured using Elrepho and Technodyne instruments (ISO Brightness—R457). All percentages are weight percent of the product to o.d. pulp.

Example I

TMP: GWD-rejects, cooked and digested for 20 min at 150° C. in a microwave, PFI mill 20,000 RPM (reduced-force beating), bleached with 2.5% $H_2O_2$. Brightness measurements are shown in Table I below.

TABLE I

| Sample Treatement | Brightness |
|---|---|
| Control | 68.37 |
| Composition B | 73.11 |

Example II

CTMP: GWD-rejects, 1.8% sodium sulfite added to the pulp, cooked and digested for 20 min at 150° C. in microwave, PFI mill 20,000 RPM (reduced-force beating), initial pH 8.1, bleached with 2.5% $H_2O_2$. Freeness (CSF, ml) and brightness measurements are shown in Table II. FiberBrite® 03PO054 ("FB03") is a pulp brightness enhancer available from Nalco Company® in Naperville, Ill.

TABLE II

| Sample Treatment | Freeness | Brightness |
|---|---|---|
| Control: no chelant* | 645 | 71.57 |
| Control: 0.2% FB03* | | 76.67 |
| 0.15% DTPA, no chelant* | 650 | 74.85 |
| 0.15% DTPA, 0.2% FB03* | | 77.33 |
| 0.15% Composition A1, no chelant* | 565 | 68.98 |
| 0.15% Composition A1, 0.2% FB03* | | 72.90 |
| Composition A1, no chelant* | 545 | 74.96 |
| Composition A1, 0.2% FB03* | | 77.51 |

*at the bleaching stage

Example III

CTMP: TMP-accepts, 0.5% NaOH and 1% $Na_2SO_3$ added to the pulp material, cooked and digested for 15 min at 120° C.; PFI mill 1,000 RPM, bleached with 2.5% $H_2O_2$. Brightness data are shown in Table III.

TABLE III

| Sample Treatment | Brightness |
|---|---|
| Control | 53.6 |
| 0.25% Composition A | 55.4 |
| 0.5% Composition A | 55.3 |

Example IV

CTMP: TMP-accepts, 0.5% NaOH and 1% $Na_2SO_3$ added to the pulp material, cooked and digested for 15 min at 120° C., PFI mill at 2,000 RPM, bleached with 2.5% $H_2O_2$. Brightness, burst index (kPa·m$^2$/g), and tensile index (Nm/g) are shown in Table IV. This example illustrates minimized brightness loss at the mechanical pulping stage in presence of alkali that was used to improve mechanical properties of handsheets made of bleached pulp.

TABLE IV

| Sample Treatment | Brightness | Burst index | Tensile index |
|---|---|---|---|
| Control | 57.8 | 0.80 | 22.3 |
| 0.5% Composition D | 57.6 | 0.97 | 24.6 |

Example V

TMP: TMP-accepts, cooked and digested for 15 min at 120° C., PFI mill at 6000 RPM, bleached with 4% $H_2O_2$. Original pH (pH-A), pH after PFI mill (pH-B), brightness measurements, burst index (kPa·m$^2$/g), and tensile index (Nm/g) are shown in Table V. Unbleached pulp had a brightness of 50.09.

TABLE V

| Sample Treatment | pH-A | pH-B | Brightness | Burst index | Tensile index |
|---|---|---|---|---|---|
| Control | 4.2 | 4.3 | 53.3 | 1.02 | 24 |
| Composition B1 | 5.0 | 4.4 | 57.87 | 1.16 | 27 |
| Composition C | 7.0 | 6.9 | 59.98 | 1.42 | 27 |
| Composition F | 8.2 | 7.1 | 55.28 | 1.32 | 29 |

Example VI

TMP: GWD-rejects, cooked and digested for 15 min at 120° C., PFI milled at 20,000 RPM, bleached with 2.5% $H_2O_2$. Original pH (pH-A), pH after PFI mill (pH-B), brightness measurements, burst index (kPa·m$^2$/g), and tensile index (Nm/g) are shown in Table VI. Moderate alkaline buffering combined with other components of the composition led to marked improvements in brightness and mechanical integrity. Such buffering is possible with trisodium phosphate or sodium metaborate that are potential alternatives to standard alkalization with sodium hydroxide. Sodium hydroxide provides higher strength, but more moderate buffering provides higher brightness. Alkalization normally negatively affects brightness, and the proposed compositions compensate for this deficiency.

TABLE VI

| Sample Treatment | pH-A | pH-B | Brightness | Burst index | Tensile index |
|---|---|---|---|---|---|
| Control | 6.4 | 5.8 | 71.30 | 1.16 | 25 |
| Composition D | 11.1 | 6.2 | 75.02 | 1.42 | 32 |
| Composition C1 | 9.2 | 6.9 | 75.91 | 1.25 | 28 |
| Composition F | 9.5 | 6.7 | 74.21 | 1.31 | 29 |

Example VII

TMP: TMP-accepts, cooked and digested for 15 min at 120° C., PFI mill at 6,000 RPM, bleached with 4% $H_2O_2$. Original pH (pH-A), pH after PFI mill (pH-B), brightness measurements, burst index (kPa·m$^2$/g), and tensile index (Nm/g) are shown in Table VII. As can be seen, trisodium phosphate is affecting strength only at high concentrations. Metaborate is more efficient at the same dose. The data also show that combined application of the new chemistry with oxidants-alkaline buffers such as perborate and especially percarbonate provides significant improvement.

TABLE VII

| Sample Treatment | pH-A | pH-B | Brightness | Burst index | Tensile index |
|---|---|---|---|---|---|
| Control | 4.3 | 4.12 | 53.43 | 1.02 | 25 |
| Composition C2 | 6.42 | 5.66 | 56.26 | 0.94 | 25 |
| Composition C1 | 6.62 | 6.51 | 56.41 | 1.25 | 24 |
| Composition F | 8.02 | 7.09 | 55.65 | 1.40 | 28 |

TABLE VII-continued

| Sample Treatment | pH-A | pH-B | Brightness | Burst index | Tensile index |
|---|---|---|---|---|---|
| Composition G | 7.53 | 7.78 | 60.7 | 1.16 | 27 |
| Composition H | 7.21 | 6.75 | 56.19 | 1.25 | 26 |

Example VIII

TMP: GWD-rejects, cooked and digested for 15 min at 120° C., PFI mill at 10,000 RPM, bleached with 3% $H_2O_2$, 1.13% sodium silicate added to the pulp. Comparative brightness measurements, burst index (kPa·m$^2$/g), and tensile index (Nm/g) are shown in Table VTII.

TABLE VIII

| Sample Treatment | Brightness drum dried | Brightness air dried | Whiteness drum dried | Whiteness air dried | Burst index | Tensile index |
|---|---|---|---|---|---|---|
| Composition B | 78.42 | 81.67 | 52.71 | 57.81 | 0.72 | 28.2 |
| Composition I | 77.31 | 81.79 | 51.49 | 57.93 | 0.95 | 28.1 |
| Composition J | 78.32 | 81.11 | 51.89 | 56.89 | 0.94 | 28.1 |
| Composition E | 77.34 | 80.92 | 49.57 | 56.22 | 0.87 | 30.5 |

Example IX

TMP: GWD-rejects, cooked and digested for 15 min at 120° C., PFI mill at 4,000 RPM, pulp material dosed with PAA and $H_2O2$ dosed as actives and Composition B as product, bleached at 70° C. for 1 hour with 3% $H_2O_2$ and 2% NaOH. Table IX shows unbleached and bleached brightness and tensile index (Nm/g).

TABLE IX

| Sample Treatment | Brightness unbleached | Brightness bleached | Tensile Index |
|---|---|---|---|
| Control | 63.23 | 73.4 | 19.36 |
| 0.5% NaOH | 60.62 | 71.7 | 23.72 |
| 0.5% NaOH | 66.24 | 77.0 | 23.41 |
| 0.05% DTPA | | | |
| 0.02% FB03 | | | |
| 0.2% $H_2O_2$ | | | |
| 0.25% NaOH | 66.45 | 77.5 | 23.11 |
| 0.25% $Na_2CO_3$ | | | |
| 0.05% DTPA | | | |
| 0.02% FB03 | | | |
| 0.2% $H_2O_2$ | | | |
| 0.5% NaOH | 65.84 | 78.8 | 25.8 |
| 0.05% DTPA | | | |
| 0.02% FB03 | | | |
| 0.2% peracetic acid | | | |
| 0.5% NaOH | 63.54 | 77.8 | 27.41 |
| 0.5% Composition B | | | |

Example X

TMP: GWD-rejects, cooked and digested for 5 min at 120° C., PFI mill at 4,000 RPM, pulp material dosed with PAA and $H_2O_2$ as actives and Composition B as product, bleached at 70° C. for 1 hour with 3% $H_2O_2$ and 2% NaOH. Table X shows bleached brightness and tensile index (Nm/g).

TABLE X

| Sample Treatment | Brightness bleached | Tensile Index |
|---|---|---|
| Control | 77.05 | 20.34 |
| 0.25% NaOH | 76.77 | 23.36 |
| 0.085% $Mg(OH)_2$ | 77.78 | 21.56 |
| 0.25% NaOH | 76.81 | 23.46 |
| 0.085% $Mg(OH)_2$ | | |
| 0.25% NaOH | 78.12 | 22.96 |
| 0.25% Composition B | | |
| 0.25% NaOH | 77.64 | 23.36 |
| 0.085% $Mg(OH)_2$ | | |
| 0.25% Composition B | | |

TABLE X-continued

| Sample Treatment | Brightness bleached | Tensile Index |
|---|---|---|
| 0.25% NaOH | 77.85 | 23.36 |
| 0.085% $Mg(OH)_2$ | | |
| 0.25% Composition A | | |
| 0.25% NaOH | 76.97 | 23.22 |
| 0.025% FB03 | | |

Example XI

Prototype product for CTMP applications (Composition A) was evaluated. The composition was applied at a rate of 6 lb/ton o.d. wood chips. The composition was applied at the refining stage, and its effect was followed during the multi-stage refining-bleaching process. The evaluation demonstrated a possibility of caustic removal at the refining stage without any negative effect on paper strength, freeness, chives, or energy consumption. Composition A also produced improvement in brightness and higher efficiency in the first stage bleaching and lesser peroxide consumption in the second stage bleaching. When Composition A was applied at the impregnation refining stage, cutting peroxide by 14 kg/ton at the second stage, bleaching did not negatively affect brightness, which was even higher than under normal conditions. Application of the composition at the refining stage provided 10 percent energy savings that, when the same energy was applied, resulted in a 10 percent productivity increase.

Example XII

The goal of this trial was to reduce the specific energy required thereby increasing production rate. Prototype products from TMP applications (Compositions B, K, and M) were evaluated. Composition K was applied at the rate of 1 lb/ton (0.45 weight percent) and sodium hydroxide at 0.5 weight percent to o.d. wood at the refiner stage. Freeness reduction was observed with each prototype ranging from 4 percent (8 ml drop) to 9.7 percent (20 ml drop). Brightness of unbleached pulp increased with Composition B by 1.0 point and 1.2 points (at 2 lb/ton dose). The gain in brightness of bleached pulp, which was not directly measured, was expected to be greater than that observed in the unbleached pulp. Breaking length, tensile strength, and tensile energy absorption ("TEA") all improved, with TEA increasing up to 24 percent.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of improving a mechanical pulping process, said method comprising:

contacting a pulp material with a surfactant composition including an effective amount of an alkyl alcohol alkoxylate surfactant having formula $RO[(CH_2CHCH_3O)_X(CH_2CH_2O)_Y]M$; wherein R is $C_4$ to $C_{40}$ straight, branched, or ring alkyl, X is from 1 to about 50, Y is from 0 to about 100, and M is H or an alkali metal;

introducing to the pulp material at least one hydrotrope, and optionally introducing to the pulp material separately from the surfactant composition, as part of the surfactant composition, or with the surfactant composition but not as part of the surfactant composition one or more formulations selected from the group consisting of one or more additional surfactants; one or more chelants; one or more reductive pulp modifiers; one or more oxidative pulp modifiers; one or more pH-controlling chemicals; and combinations thereof, wherein the mechanical pulping process is one selected form the list consisting of: stone ground wood; pressurized ground wood; refiner mechanical pulp; pressurized refiner mechanical pulp; thermo-refiner mechanical pulp; thermo-mechanical pulp, and wherein substantially all of the surfactant composition is passed along with the pulp material into a refiner and wherein the resulting paper has a higher brightness than if the alkyl alcohol alkoxylate surfactant had not been added.

2. The method of claim 1, wherein R is $C_8$ to $C_{22}$ straight, branched, or ring alkyl, X is from 1 to about 20, and Y is from 1 to about 80.

3. The method of claim 1, including contacting the pulp material with about 0.001 weight percent to about 5 weight percent of the alkyl alcohol alkoxylate surfactant, based on oven-dry pulp.

4. The method of claim 1, including introducing to the pulp material about 0.001 weight percent to about 5 weight percent of the hydrotrope(s), based on oven-dry pulp.

5. The method of claim 1, including introducing to the pulp material the hydrotrope formulation as part of the surfactant composition if at least one other optional formulation is introduced to the pulp material as part of the surfactant composition.

6. The method of claim 1, including introducing to the pulp material about 0.005 weight percent to about 5 weight percent of the reductive pulp modifier(s), based on oven-dry pulp.

7. The method of claim 1, including introducing to the pulp material about 0.01 weight percent to about 5 weight percent of the oxidative pulp modifier(s), based on oven-dry pulp.

8. The method of claim 1, including introducing to the pulp material about 0.05 weight percent to about 10 weight percent of the pH-controlling chemical(s), based on oven-dry pulp.

9. The method of claim 1, wherein the pH-controlling chemical includes an alkali and introducing the alkali to the pulp material improves the mechanical strength of the paper product without decreasing the brightness of the paper product.

10. The method of claim 1, including contacting the pulp material with the surfactant composition and introducing to the pulp material one or more of the formulation(s) at the same stage of the mechanical pulping process.

11. The method of claim 1, including simultaneously or sequentially contacting the pulp material with the composition and introducing to the pulp material one or more of the formulation(s).

12. The method of claim 1, wherein contacting the pulp material either prior to refining or during refining.

13. The method of claim 1, wherein the pulp material is selected from the group consisting of wood chips; mechanical pulp; and combinations thereof.

14. The method of claim 1, including improving the mechanical pulping process by decreasing freeness and amount of shives, providing energy and chemical savings, and enhancing brightness and mechanical strength of a paper product made from the pulp material in the mechanical pulping process.

15. A method of improving a mechanical pulping process, said method comprising:

contacting a pulp material with a surfactant composition including an effective amount of an alkyl alcohol alkoxylate surfactant having formula $RO[(CH_2CHCH_3O)_X(CH_2CH_2O)_Y]M$; wherein R is $C_4$ to $C_{40}$ straight, branched, or ring alkyl, X is from 1 to about 50, Y is from 0 to about 100, and M is H or an alkali metal;

introducing to the pulp material about 0.001 weight percent to about 5 weight percent of at least one hydrotrope, based on oven-dry pulp, and introducing to the pulp material separately from the surfactant composition, as part of the surfactant composition, or with the surfactant composition but not as part of the surfactant composition one or more formulations selected from the group consisting of one or more additional surfactants; one or more chelants; one or more reductive pulp modifiers; one or more oxidative pulp modifiers; one or more pH-controlling chemicals; and combinations thereof, wherein the mechanical pulping process is one selected form the list consisting of stone ground wood; pressurized ground wood; refiner mechanical pulp; pressurized refiner mechanical pulp; thermo-refiner mechanical pulp; thermo-mechanical pulp, and wherein substantially all of the surfactant composition is passed along with the pulp material into a refiner.

* * * * *